US005265870A

United States Patent [19]

Merino

[11] Patent Number: 5,265,870

[45] Date of Patent: Nov. 30, 1993

[54] BASKETBALL RETURN APPARATUS

[76] Inventor: Dana Merino, 4418 Vantage Ave., #1, Studio City, Calif. 91604

[21] Appl. No.: 946,896

[22] Filed: Sep. 18, 1992

[51] Int. Cl.[5] ..... A63B 63/08

[52] U.S. Cl. ..... 273/1.5 A

[58] Field of Search ..... 273/1.5 A, 396; D21/201

[56] References Cited

U.S. PATENT DOCUMENTS

| | | | |
|---|---|---|---|
| 4,244,569 | 1/1981 | Wong | 273/1.5 A |
| 4,706,954 | 11/1987 | Kershaw | 273/1.5 A |
| 4,786,052 | 11/1988 | Zinger | 273/1.5 A |
| 4,957,289 | 9/1990 | Kotlarz | 273/1.5 A |
| 5,141,224 | 8/1992 | Nolde et al. | 273/1.5 A |

*Primary Examiner*—Paul E. Shapiro

*Attorney, Agent, or Firm*—Michael A. Painter

[57] ABSTRACT

A basketball return apparatus to return a basketball passing through a hoop to the shooter irrespective of the location from the basketball court from which the basketball was shot. A mounting bracket is removably coupled to the bracket which secures the basketball hoop to the backboard. The counting plate depends vertically downwardly from the bracket and is integral with an intermediate forwardly extending panel. The intermediate forwardly extending panel is integral with the primary deflection panel which forwardly extends beneath the basketball hoop and to a point forwardly from the basketball hoop. The deflection panel extends laterally beyond the diameter of the hoop to allow deflection of basketballs passing through the basketball hoop at an oblique angle.

4 Claims, 2 Drawing Sheets

FIG. 1.
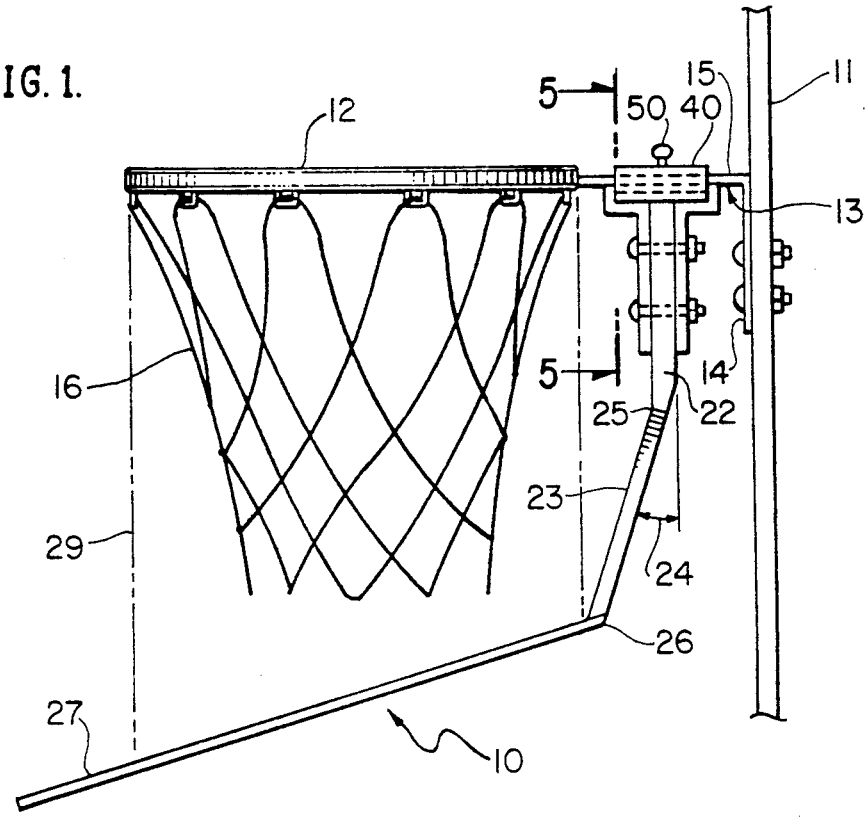
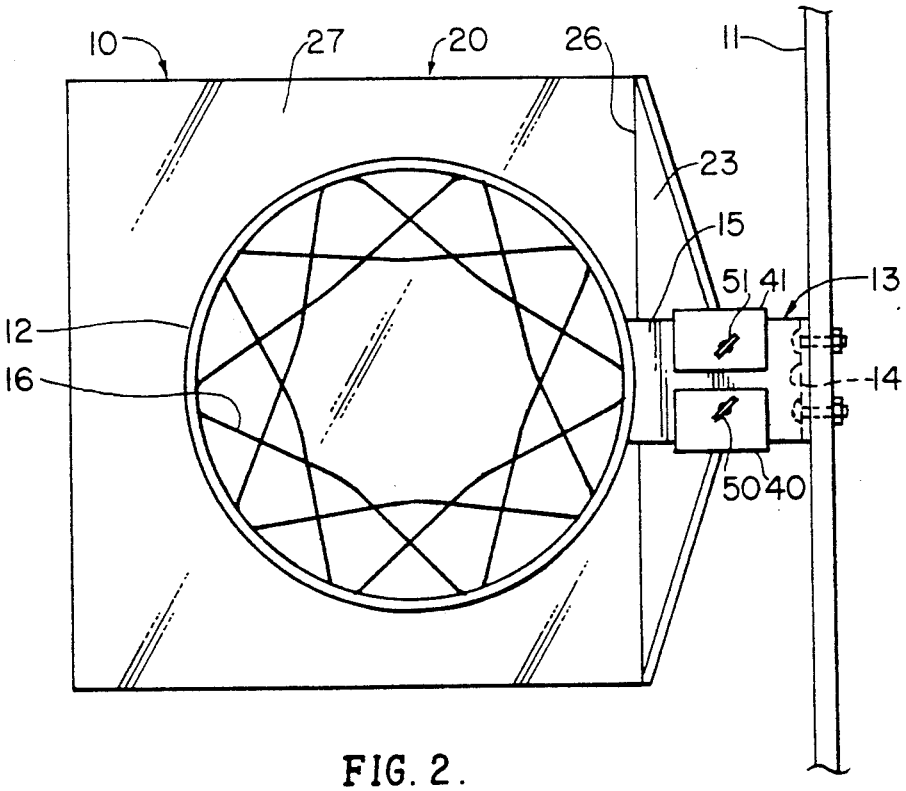
FIG. 2.

BASKETBALL RETURN APPARATUS

BACKGROUND OF THE INVENTION

1. Field of the Invention

The present invention generally relates to devices intended to return a basketball to the shooter and, more particularly, to those devices which will return the basketball to the location on the basketball court from which the basketball was shot.

2. Prior Art

With the increased popularity of the game of basketball, it has been recognized that the proficiency of one shooting a basketball is increased through repetitive practice. The basic object of the game of basketball is to shoot the ball through an annular hoop or rim and the inverted, truncated conical net which is suspended therefrom. It is an accepted axiom that a basketball player will become more adept at successfully shooting a basketball through repetitive shooting practice.

The prior art discloses a number of devices which have been intended to facilitate the return of a basketball to the shooter in order to permit efficient and repetitive shooting practice. In the absence of a return device, a basketball passing through a basketball rim or hoop can bounce in substantially any direction upon striking the ground or playing surface. This is particularly true where a conventional conical net is suspended from the hoop. The lower terminus of the net has a diameter which is less than the diameter of the basketball. As a result, as the basketball passes through the net it will be temporarily suspended and therefore deflected in a direction which is influenced by the tension in the net, the direction from which the basketball was shot, the angle at which the basketball passes through the hoop relative to the playing surface, etc. The one fact commonly accepted by all basketball players is that he or she will generally be required to retrieve a successfully shot ball before the next shot may be taken.

The prior art discloses many devices which attempt to return a basketball to the shooter after a successful shot (i.e., a ball passing through the basketball hoop) has been made. U.S. Pat. No. 5,098,090 discloses a basketball return device in which a circular mounting ring is attached to the basketball net. A curved track is attached below the mounting ring to direct the basketball toward the shooter. In order for the shooter to change position and allow the ball to be returned to the new location, the positioning of the mounting ring relative to the basketball hoop must be changed accordingly. The inadequacies in this device are obvious. In order to meet the primary objective of any basketball return device, the shooter must be able to repetitively shoot from different positions and have the ball returned irrespective of where the ball has been shot from. In this case, the most glaring deficiency is in the manner in which the mounting ring is coupled to the basketball net or hoop. Each time the shooter changes position, the position of the mounting ring must be physically changed.

U.S. Pat. No. 4,786,052 discloses a device in which a flat mounting plate is secured between the basketball backboard and the mounting bracket which secures the basketball hoop. The mounting plate extends into a downwardly extending forwardly inclined basketball deflector, the dimensions and orientation of which are specifically defined. Though extending directly beneath the basketball net, it specifically does not extend in any lateral or forward direction to the vicinity beneath the basketball hoop. The inadequacies in this device are inherent in its limitations. By being secured directly between the basketball backboard and the mounting bracket, the basketball facilities will be unavailable for use in a conventional game since all balls passing through hoop would be deflected. Furthermore, because of the defined structure of the deflection plate relative to the basketball hoop, the ball will be returned to the shooter only if the ball is shot from a location directly forwardly from the hoop. Lastly, the rigid coupling between the deflection member and the mounting plate will not provide the resiliency required to withstand the repetitive impact and forces resulting from a basketball passing through the hoop and net.

The present invention resolves those problems inherent in the devices disclosed by the prior art. The present invention basketball deflection apparatus is coupled to the basketball hoop support by a coupling which will allow the present invention to be attached or removed at will. The mounting plate for the present invention extends downwardly in parallel spaced relation to the backboard. The mounting plate is integral with an intermediate deflection panel which off-set from the plane of the backboard by a small acute angle. The intermediate deflection panel is integral with a primary deflection panel which extends downwardly and forwardly beneath the basketball net. The primary deflection panel extends laterally and forwardly beyond an imaginary cylinder defined by the basketball hoop. When combined with the movement of the basketball net resulting from a basketball passing through the hoop, the present invention will return the basketball to the approximate location from which it was shot.

SUMMARY OF THE INVENTION

The present invention provides an improved basketball return apparatus which will consistently return the basketball to the location where the shot was initiated without any alteration of the position of the apparatus. The present invention is adapted to be used with conventional basketball equipment. The typical equipment with which the present invention is used comprises an assembly of an annular basketball hoop or rim mounted to a backboard by a mounting bracket which maintains the basketball rim horizontal to the playing surface and perpendicular to the backboard.

The present invention comprises a mounting plate which is substantially the width of the mounting bracket and which can be removably coupled to the horizontal portion of the mounting bracket. The mounting plate is integral with an intermediate deflection panel, the joint between the mounting plate and the intermediate deflection panel providing a resilient coupling therebetween. The intermediate deflection panel is off-set from the plane of the backboard by a small acute angle. The intermediate deflection panel is integral with and depends forwardly and downwardly into the primary deflection panel. The primary deflection panel extends downwardly and forwardly beneath the basketball hoop and net and extends laterally and forwardly beyond an imaginary cylinder extending downwardly from the basketball rim. The lateral and forward edges of the primary deflection panel extend beyond the imaginary cylinder by at least one-half the diameter of a conventional basketball.

Any basketball which passes through the basketball hoop and net will be returned by the present invention to the approximate location from which the shot was initiated. Irrespective of the height and angle of the shot, when the basketball passes through the net, the net and basketball will temporarily be moved from the net's quiescent condition. As the basketball passes through the net, it will be deflected away from the shooter in the plane define by the shot. As the net and ball swing back toward the quiescent condition, the backspin of the ball and the force exerted on the ball toward the shooter, when combined with contact with the primary deflection panel, will return the ball to the approximate location from where the shot originated.

It is therefore an object of the present invention to provide an improved basketball return apparatus.

It is another object of the present invention to provide a basketball return apparatus which will return the basketball to the approximate location from which the shot was initiated.

It is still another object of the present invention to provide a basketball return apparatus which can be removably attached to the mounting bracket for a basketball hoop.

It is still yet another object of the present invention to provide an improved basketball return apparatus which is inexpensive and simple to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 is a side elevation view of the present invention basketball return apparatus mounted in conjunction with a basketball backboard and hoop.

FIG. 2 is a top plan view of the basketball hoop and present invention basketball return apparatus shown in FIG. 1.

DESCRIPTION OF THE PRESENTLY PREFERRED EMBODIMENT

Figure 3:
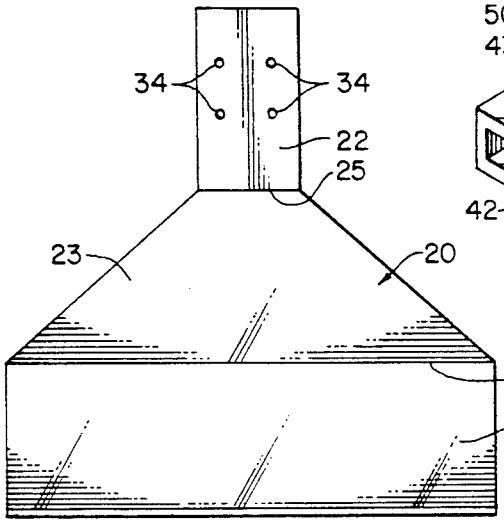
FIG. 3 is a front elevation view of the basketball return apparatus shown in FIGS. 1 and 2.

An understanding of the present invention may be best gained by reference to FIGS. 1, 2 and 3 wherein a basketball return apparatus constructed according to the present invention is illustrated and generally designated by the reference numeral 10. The present invention basketball return apparatus 10 is used in conjunction with a basketball hoop assembly which typically comprises a backboard 11, an annular horizontally disposed basketball hoop 12 and a right-angled mounting bracket 13 for securing basketball hoop 12 to backboard 11. Mounting bracket 13 comprises a vertical member 14 which is coupled to backboard 11 through conventional means and an integral horizontal member 15 which is disposed at a right angle to vertical member 14. Horizontal member 15 is welded or otherwise secured to the periphery of annular basketball hoop 12 which is supported horizontal relative to the ground or other playing surface. An inverted truncated conical net 16 is suspended beneath basketball hoop 12. It is understood that backboard 11, mounting bracket 13, basketball hoop 12 and net 16 constitute conventional elements of the game of basketball and do not form part of the present invention.

Figure 4:
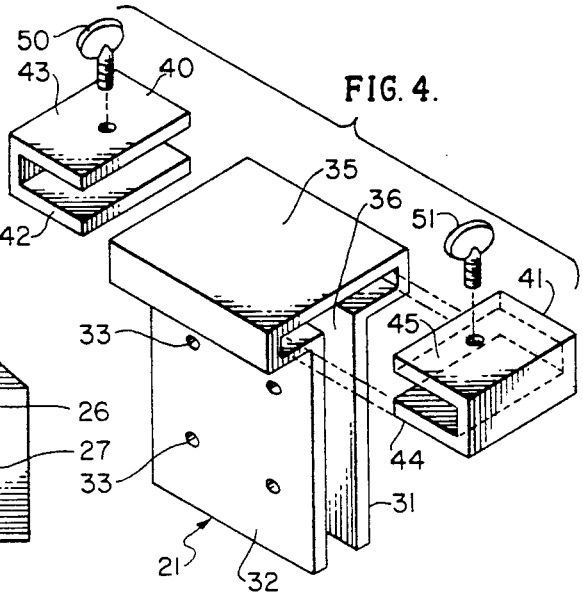
FIG. 4 is an enlarged, assembly view of the mounting assembly used to removably secure the present invention to the basketball hoop mounting bracket.

The present invention basketball return apparatus 10 is comprised of a ball return deflector 20 which is shown in FIG. 3 and a mounting assembly 21 shown in FIG. 4. Ball return deflector 20 comprises three integral members. Mounting plate 22 is a substantially rectangular flange which is adapted to be coupled to horizontal member 15 in parallel spaced relation to backboard 11. Mounting plate 22 is integral with and depends forwardly and downwardly into intermediate deflection panel 23 at resilient interface or joint 25. As can be best seen in FIG. 1, intermediate deflection panel 23 is arcuately spaced from the plane of mounting plate 22 by approximately 5° of arc, a feature which is designated by the reference numeral 24. At the resilient interface or joint 25, the width of intermediate deflection panel 23 is equal to the width of mounting bracket 22. As can be best seen in FIG. 3, intermediate deflection panel 23 expands laterally to resilient interface or joint 26 at which point it is integral with and depends forwardly and downwardly into primary deflection panel 27. At resilient joint 26, the width of intermediate deflection panel 23 is equal to the width of primary deflection panel 27. As will be discussed in detail hereinbelow, in order to meet the objectives of the present invention to return a ball to the approximate location from where a shot was originated, the angle of deflection between mounting plate 22 and primary deflection panel 27 should be in the range of 120°–130° of arc.

In order to meet the objectives of the present invention, the basketball return apparatus 10 must be capable of a resilient response to the force imposed by a basketball after passing through basketball hoop 12 and net 16. The integral form of mounting bracket 22, intermediate deflection panel 23 and primary deflection panel 27 are preferably constructed of plexiglass or other deformable material which will withstand the force of the basketball and impose a resilient force on the basketball when it is being returned to the shooter. By forming the present invention from three integral sections which are joined at resilient joints 25 and 26, the force imposed by the basketball will be absorbed by the resiliency of joints 25 and 26. A counterforce is applied to the basketball when the structure returns to its original condition. In order for the present invention to properly respond to basketballs which enter the basketball hoop 12 from a direction other than that directly in front of the backboard, it is necessary for primary deflection panel 27 to extend laterally and forwardly beyond an imaginary cylinder 29 which constitutes a downward projection of the circumference of basketball hoop 12. As can be seen best in FIG. 2, primary deflection panel 27 extends forwardly and laterally beyond imaginary cylinder 29 by a distance which is at least ½ the diameter of a conventional basketball (e.g., 6").

An object of the present invention is to provide a basketball return apparatus 10 which can be easily attached or removed from mounting bracket 13. Referring now to FIG. 4, an assembly view of the preferred embodiment of mounting assembly 21 is shown. Mounting assembly 21 comprises a pair of flanges 31 and 32 which are in parallel spaced relation to each other, the separation thereof being adapted to receive mounting plate 22. A plurality of aligned apertures 33 are disposed through flanges 31 and 32 and are adapted to be aligned with an equal number of apertures 34 disposed through mounting plate 22 (FIG. 3). Mounting plate 22 is secured between flanges 31 and 32 by the plurality of conventional threaded bolts and nuts 37. Flanges 31 and 32 are coupled together at the upper ends thereof by a receiving member 35 which defines a cavity 36 which is perpendicular to the gap intermediate flanges 31 and 32, cavity 36 being accessible at either lateral end of the receiving member 35. Mounting assembly 21 also comprises a pair of clamping vices 40 and 41. Clamping vice 40 includes a lower clamping flange 42 and an upper clamping flange 43. In a like manner, clamping vice 41 includes a lower clamping flange 44 and an upper clamping flange 45.

Figure 5:
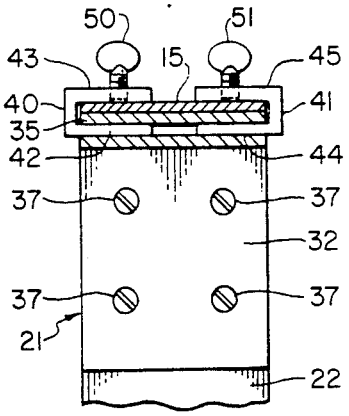
FIG. 5 is an enlarged, partial cross-sectional view of the mounting assembly shown in FIG. 1 and FIG. 4 taken through line 5—5 of FIG. 1.

The manner in which the mounting assembly 21 is coupled to the horizontal member of mounting bracket 13 can be best seen by reference to FIG. 5. Receiving member 35 is disposed adjacent horizontal member 15 on the underside thereof with flanges 31 and 32 and mounting plate 22 being placed in parallel spaced relation to backboard 11. To insert the clamping vices 40 and 41, lower clamping flanges 42 and 44 are placed within cavity 36, upper clamping flanges 43 and 45 being placed adjacent the upper surface of horizontal member 15. Mounting assembly 21 is held in place through forces exerted on the upper surface of horizontal 15 by a pair of set screws 50 and 51. Although the form of mounting assembly 21 as shown in FIG. 4 and FIG. 5 is a preferred manner of constructing this element of the present invention, it is understood that the objective of the present invention may be met by other couplings which will permit a basketball return apparatus to be mounted and removed from mounting bracket 13 at will.

Figure 6:
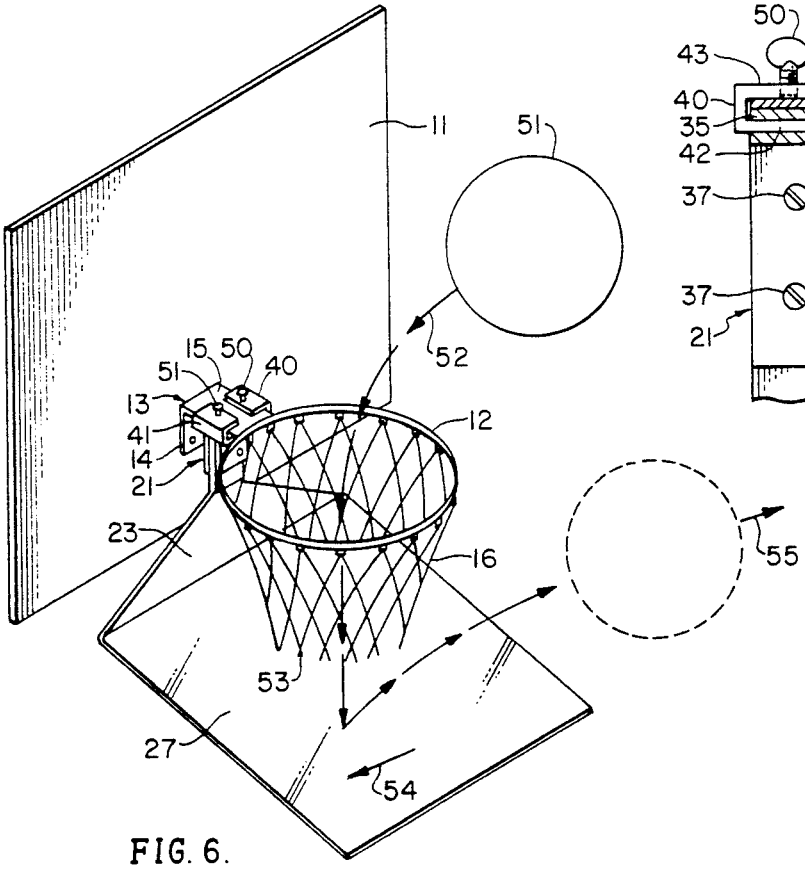
FIG. 6 is a perspective view of the present invention schematically depicting the return of a basketball to the location where a shot was originated.

The operation of the present invention basketball return apparatus can be best understood by reference to FIG. 6. FIG. 6 illustrates a basketball 51 being shot from a lateral position, i.e., more than 45° from a location directly in front of the backboard. The path of the basketball is designated by the reference numeral 52. Since path 52 represents the typical projectory of a basketball, it is understood that when the basketball 51 contacts the bottom 53 of the truncated conical net 16, the force of the basketball will cause the net 16 and the temporarily suspended ball 51 to be urged away from a vertical position in the direction designated by the reference numeral 54. As a general rule, direction 54 will be a continuation of the horizontal vector of the trajectory of basketball 51. Since net 16 is being suspended from basketball hoop 12, the momentum of basketball 51 will cause the net to swing back toward its original position. Since a conventional basketball net 16 only temporarily suspends the movement of basketball 51, the backspin of the basketball 51 will cause it to be ejected from the net in the direction represented by the reference numeral 55. It can therefore be seen that the orientation of primary deflection panel 27 in combination with the movement of net 16 will cause basketball 51 to be returned to approximately the location from which the shot originated.

I claim:

1. A basketball return apparatus comprising:

(a) a vertical backboard;

(b) a horizontal, annular basketball hoop;

(c) a mounting bracket having a horizontal member coupled intermediate the basketball backboard and the annular hoop and maintaining the basketball hoop perpendicular to the backboard;

(d) a truncated conical net coupled to the basketball hoop;

(e) a mounting plate vertically disposed below and coupled to the horizontal member of the mounting bracket;

(f) a first deflection panel being resiliently coupled to and depending downwardly and forwardly from the mounting plate and being beneath the horizontal member between the backboard and the annular hoop; and (g) a second deflection panel being resiliently coupled to and depending forwardly and downwardly from said first deflection panel and being disposed beneath and beyond the lateral and forward extents of the annular hoop.

2. A basketball return apparatus as defined in claim 1 wherein the mounting plate is in parallel spaced relation to the vertical backboard.

3. A basketball return apparatus as defined in claim 2 wherein the first deflection panel is angularly deflected from the plane of the mounting plate by 5° of arc.

4. A basketball return apparatus as defined in claim 3 wherein the second deflection plate is offset downwardly from the plane of the horizontal annular hoop by an angle in the range of 30°–40° of arc.

* * * * *